United States Patent [19]

Young et al.

[11] Patent Number: 4,480,523

[45] Date of Patent: Nov. 6, 1984

[54] ELECTROMAGNETIC PROJECTILE LAUNCHING SYSTEM WITH A CONCENTRIC RAIL GEOMETRY

[75] Inventors: Frederick J. Young, State College; William F. Hughes, Cambridge Springs; Daniel W. Deis, Churchill Borough; Ian R. McNab, Murrysville, all of Pa.

[73] Assignee: Westinghouse Electric Corp., Pittsburgh, Pa.

[21] Appl. No.: 319,029

[22] Filed: Nov. 6, 1981

[51] Int. Cl.[3] ..... F41F 1/00

[52] U.S. Cl. ..... 89/8; 124/3

[58] Field of Search ..... 89/8; 124/3

[56] References Cited

U.S. PATENT DOCUMENTS 1,370,200 3/1921 Fauchon-Villeplee ..... 89/8

4,369,691 1/1983 Baehr, Jr. et al. ..... 89/8

OTHER PUBLICATIONS

LA-8000-C, "Electromagnetic Accelerator Concepts", pp. 206, 212-213, Kolm.

*Primary Examiner*—S. A. Cangialosi

*Attorney, Agent, or Firm*—R. P. Lenart

[57] ABSTRACT

An electromagnetic projectile launching system utilizes two cylindrical rail configurations. In one configuration, multiple conductive armatures are electromagnetically accelerated along rails which are located on the inner surface of a cylindrical barrel. The second configuration utilizes armatures located between concentric cylindrical rails. Rifling provides for spin stabilization of the projectile.

24 Claims, 19 Drawing Figures

FIG. 1
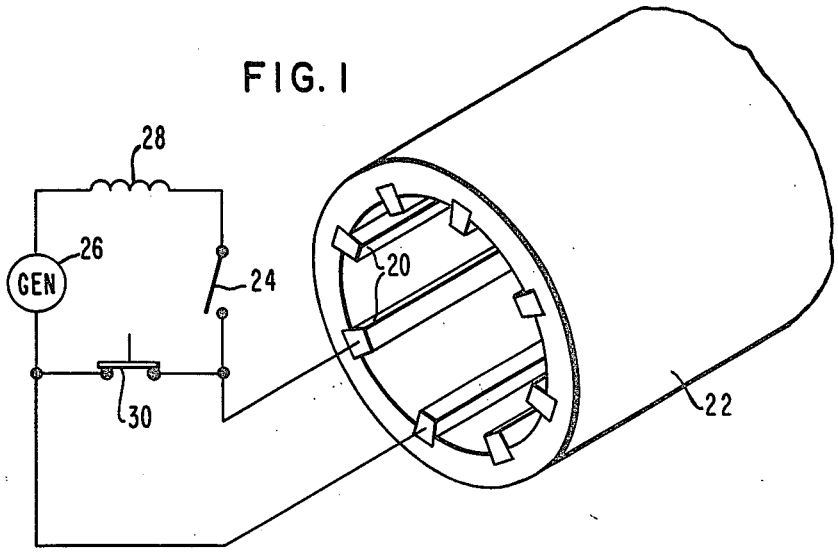
FIG. 2
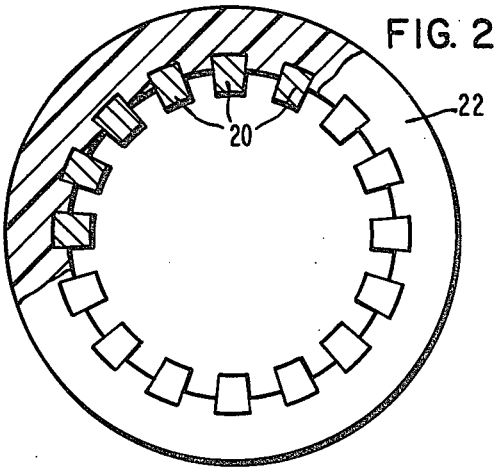
FIG. 3
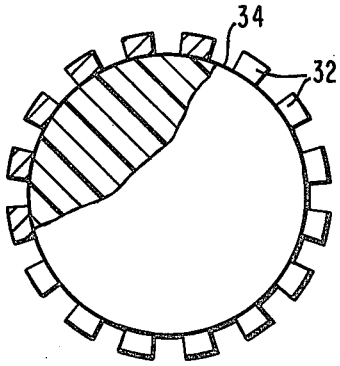
FIG. 4
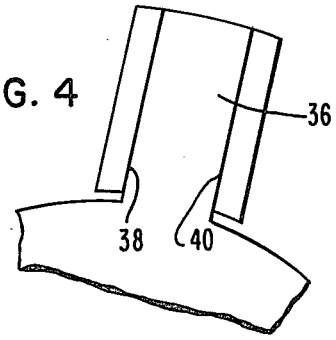
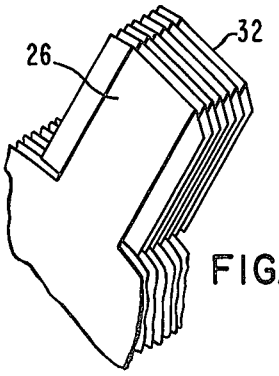
FIG. 5

FIG. 6
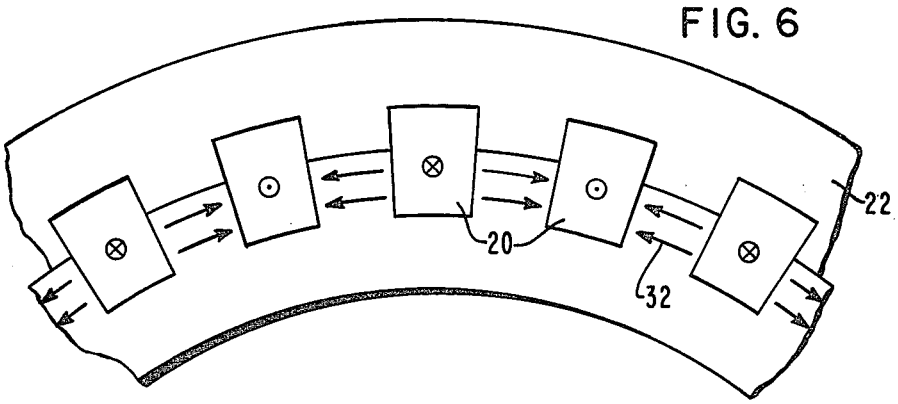
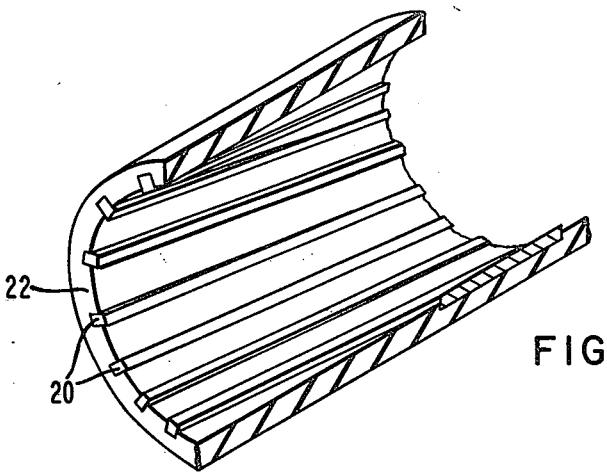
FIG. 7
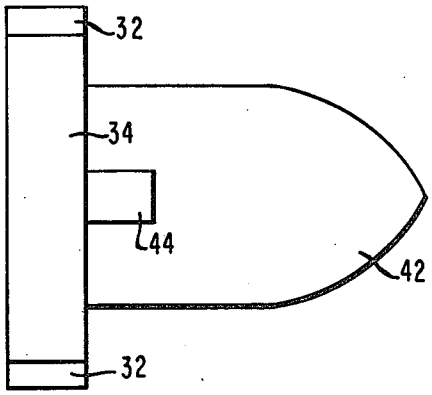
FIG. 8

FIG. 11
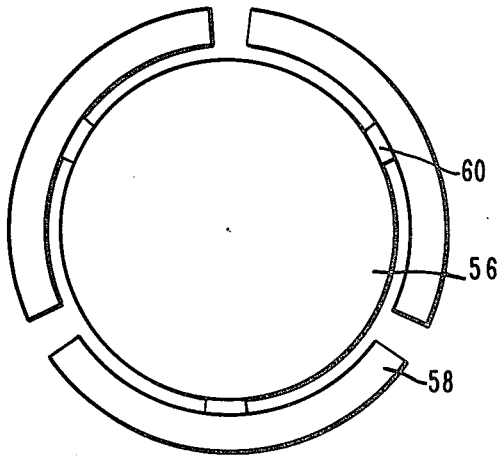
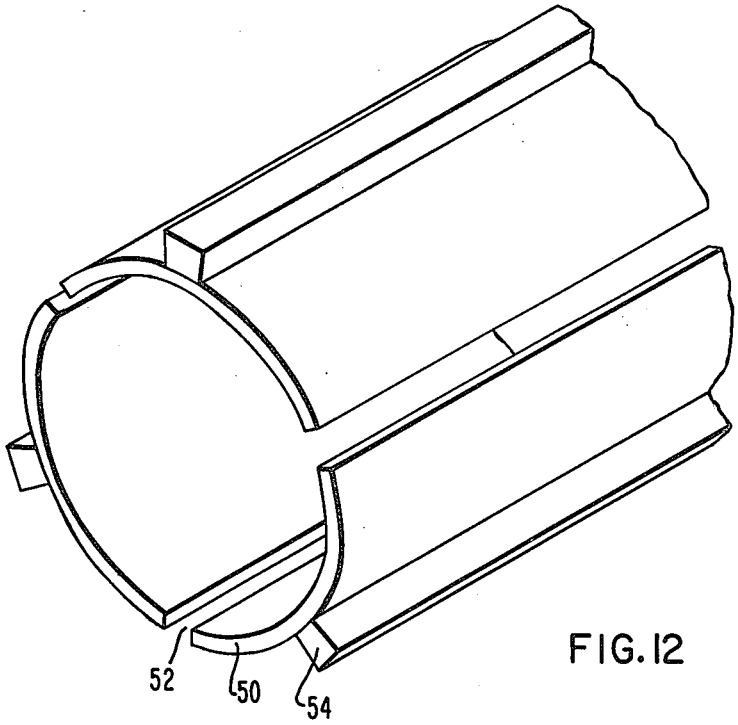
FIG. 12

FIG. 13
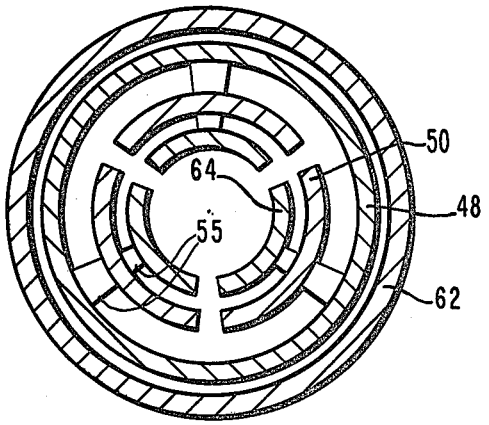
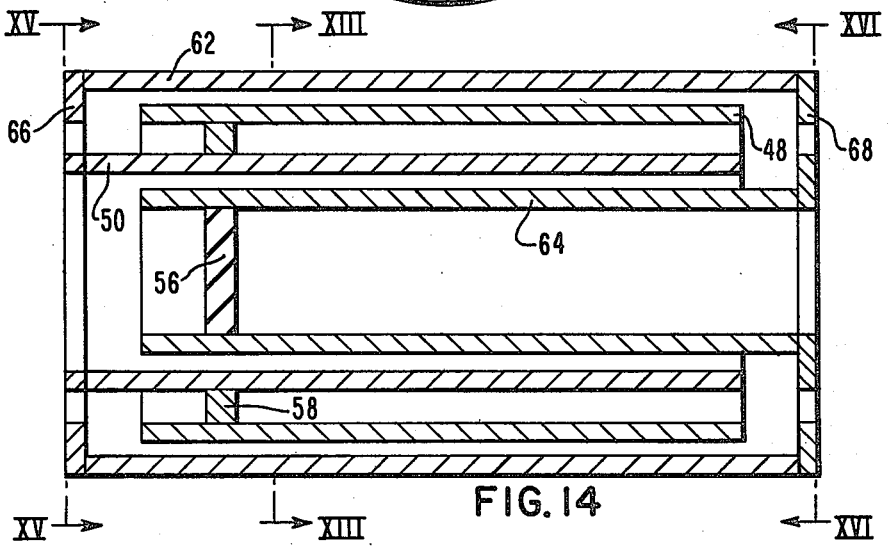
FIG. 14
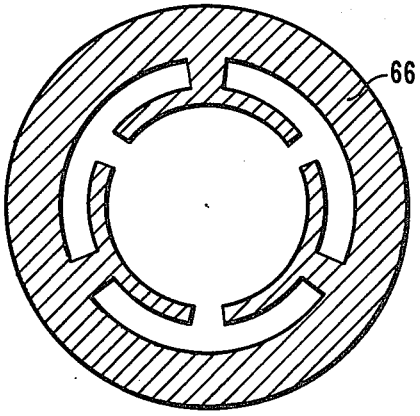
FIG. 15
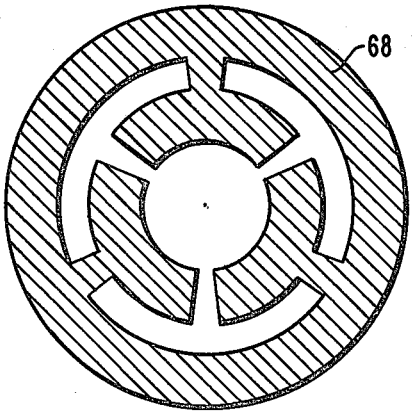
FIG. 16

ELECTROMAGNETIC PROJECTILE LAUNCHING SYSTEM WITH A CONCENTRIC RAIL GEOMETRY

BACKGROUND AND SUMMARY OF THE INVENTION

This invention relates to electromagnetic projectile launching systems and more particularly to such systems which use a cylindrical rail arrangement to accelerate the projectile.

Electromagnetic projectile launchers are known which comprise a pair of conductive rails, a sliding conductive armature between the rails, a source of high current, and means for commutating this current into the rails and through the armature. This places an electromagnetic force on the armature which propels it along the conductive rails. An early launcher employing this concept is disclosed in U.S. Pat. No. 1,370,200, dated Mar. 1, 1921.

Present electromagnetic projectile launchers utilize a pair of parallel rectangular rails to accelerate a projectile. Copending application Ser. No. 185,706, filed Sept. 10, 1980, now U.S. Pat. No. 4,369,691, entitled "Projectile Launching System With Resistive Insert in the Breech", and assigned to the present assignee, illustrates a launcher with parallel rectangular rails. The distribution of current in the rails and armatures of these launchers is non-uniform because of the skin effect. Current concentrates on the rail surfaces and rail corners leading to intense local heating in the rails and armature. Since there is no way to rotate the projectile during launching, fins must be used as stabilizers. In addition, the leakage of magnetic flux from the vicinity of the launcher assembly provides a magnetic signature which may be detectable at significant distances from the launcher. The reduction of this magnetic signature is essential in some applications.

The present invention seeks to achieve a more uniform current distribution in the launcher rails, reduce magnetic signature, and provide means for spin stabilization of the projectile. These objectives are achieved by two different cylindrical launcher configurations.

The first configuration comprises a barrel with multiple rails located along the inner surface. These rails are connected to a source of high current such that current flows in the opposite direction in any two adjacent rails. A plurality of conductive armatures are located between the rails and attached to the periphery of a core such that a high current in the rails and armatures electromagnetically propels the core and armatures along the barrel. This configuration reduces the far magnetic field signature to a multi-pole field which will be considerably less that of a single two parallel rail geometry.

By twisting the conductors, the barrel can be effectively rifled. This will impart a spin to the core during launch which can be transferred to a projectile by a splined or keyed shaft, thereby providing spin stabilization for the projectile.

The second configuration comprises a cylindrical outer rail with a coaxial cylindrical inner rail. Conductive armatures are located between these rails and are propelled along them when a high current flows in the rails and armatures. A projectile is driven by a plug located within the inner rail. This plug is connected to the armatures by rigid insulating supports which pass through axial slots in the inner rail. By twisting the slots, spin can be imparted to the plug during launch. This spin can be transferred to a projectile by a splined or keyed shaft, thereby providing spin stabilization for the projectile.

Alternatively, a liquid can be used to couple armature movement to a projectile. The liquid would be located within the cylindrical rails such that movement of the armature would force liquid from the space between the cylindrical rails into the center of the inner cylindrical rail, thereby moving the projectile. This second configuration virtually eliminates far magnetic field signature.

Each of these configurations can be constructed with augmenting rails to increase projectile force for a given current. A launcher employing the augmenting rail concept is disclosed in copending application Ser. No. 137,059, filed Apr. 3, 1980, now U.S. Pat. No. 4,347,463, entitled "Electromagnetic Projectile Launcher With Self-Augmented Rails", and assigned to the present assignee.

BRIEF DESCRIPTION OF THE DRAWINGS

FIG. 1 shows an embodiment of an electromagnetic projectile launching system in accordance with the present invention;

FIG. 2 shows an end view of a barrel for the type of launching system shown in FIG. 1;

FIG. 3 shows a core used to drive projectiles along the barrel of FIG. 2;

FIG. 4 shows an embodiment of an armature leaf for use in the armatures shown in FIG. 3;

FIG. 5 shows an embodiment of one of the armatures shown in FIG. 3;

FIG. 6 illustrates the current flow in the rails and armatures of a launcher made in accordance with the present invention;

FIG. 7 illustrates barrel rifling created by twisting the rails of a barrel made in accordance with the present invention;

FIG. 8 illustrates an embodiment of a means for transferring spin from a core to a projectile in accordance with the present invention;

FIG. 11 shows an armature assembly for use in the launcher of FIG. 10;

FIG. 12 shows the inner electrode assembly for the launcher of FIG. 10;

FIG. 13 shows the addition of augmentation electrodes to the launcher of FIG. 10;

FIGS. 14, 15 and 16 show the end cap connectors use in the launcher of FIG. 13;

DESCRIPTION OF THE PREFERRED EMBODIMENTS

Figure 9:
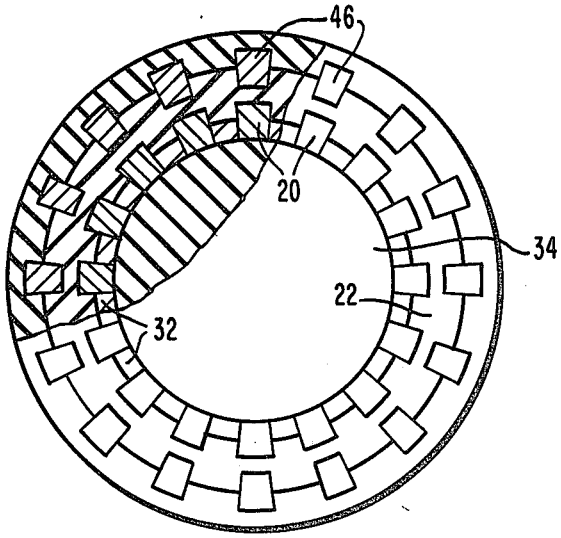
FIG. 9 shows the addition of augmentation rails to the barrel of FIG. 2.

FIG. 1 shows an embodiment of a multiple-rail cylindrical electromagnetic launching system in accordance with the present invention. Multiple rails 20 are distributed azimuthally around the inner surface of barrel 22 which is made of an insulating material. The rails 20 are embedded in slots in barrel 22 for support.

When switch 24 is closed, a direct current source such as homopolar generator 26 charges inductor 28 to full current. Then circuit breaker 30 is opened, delivering a high current to rails 20. For clarity, the current source is shown as being connected to only two rails. However, it must be understood that all rails would be connected to the current source such that current in adjacent rails flows in the opposite direction. Movable armatures as shown in FIGS. 3, 4 and 5 are located between rails 20 to complete the circuit. A high current flowing in these armatures and rails electromagnetically propels the armatures along the rails.

FIG. 2 is a muzzle end view of a barrel section for a launcher such as shown in FIG. 1. An even number of rails 20 are embedded in slots which are azimuthally located on the inner surface of barrel 22. During a launch, electromagnetic forces on the rails tend to separate the rails by moving them out radially. The barrel provides restraint and support against this motion. The circular cross-sectional shape of the barrel is ideally suited for this purpose.

FIG. 3 is an end view of a projectile driving armature assembly which would be slidably disposed in the barrel shown in FIG. 2. The assembly comprises an even number of armatures 32 located along the perimeter of core 34. These armatures 32 correspond to the spaces between rails 20 in FIG. 2.

FIG. 4 is a detail drawing of an embodiment of an armature leaf 36 which is representative of one of a stack of leaves used to construct an armature. Slight bends are made along lines 38 and 40 to improve electrical contact with the rails while the armatures are sliding. FIG. 5 shows a complete armature 32 comprising a stack of armature leaves 36.

FIG. 6 illustrates the current flow in rails 20 and armatures 32 during a launch. The arrows in FIG. 6 illustrate that current flows in the opposite direction in adjacent rails. This results in a multi-pole far magnetic field which is considerably less than the far magnetic field created by prior art launchers which used a single pair of parallel projectile launching rails.

Barrel rifling created by twisting rails 20 along the inner surface of barrel 22 is illustrated in FIG. 7. This rifling will cause the projectile driving armature assembly to spin during a launch. FIG. 8 illustrates an embodiment of a means for transferring this spin to a projectile 42. Shaft 44 fits into projectile 42 and is rigidly attached to projectile driving armature assembly core 34. Shaft 44 can be splined or keyed so that shaft rotation will cause projectile rotation.

The total force on a projectile in a multiple-rail cylindrical launcher is less than the total force on a projectile in a prior art parallel rail launcher for a given current in the rail system. The force on each armature is given by $\frac{1}{2} LI_p^2$ where L and $I_p$ are the inductance and current of one pitch. If there are n rails, and hence n armatures, the current per pitch is I/n. The inductance of a single rail section is dependent only on the aspect ratio of the armature slot, which can be similar to the aspect ratio of a prior art two rail system. Therefore, the total force on a projectile is $(\frac{1}{2}n)\ LI^2$, which is a factor of 1/n of that for a prior art launcher for the same total current.

A reduction in projectile force may be acceptable in certain use conditions of the present invention in order to achieve the objectives of reduced magnetic signature, spin stabilization of projectiles through rifling, and better current distribution in the rails through a reduction in skin effect. However, this reduction in projectile force can be mitigated through the use of augmentation rails disposed generally parallel to the primary rails. FIG. 9 shows a cross section of a multiple-rail launcher barrel containing primary rails 20 and augmentation rails 46. The augmentation rails are electrically connected in series with the primary rails such that current flows in the same direction in primary rails and augmentation rails which are radially in line. It should be apparent that additional augmentation rails could be used by positioning them to the outside of the augmentation rails shown in FIG. 9.

The use of augmentation rails increases the energy transferred to a projectile for a given current in the launcher rails. This allows the use of a smaller current to achieve a given force on a projectile, resulting in a smaller temperature rise in the barrel for a given amount of energy transferred to a projectile. The reduction in temperature rise permits the firing rate to be raised over that of an unaugmented launcher.

Figure 10:
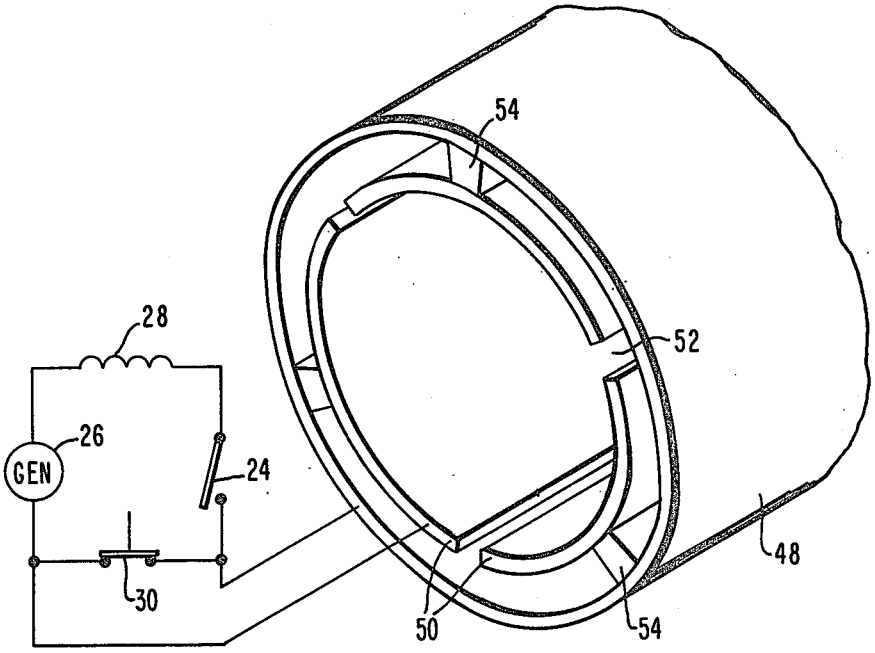
FIG. 10 shows an embodiment of a coaxial electromagnetic projectile launching system in accordance with the present invention.

FIG. 10 shows an embodiment of a coaxial electromagnetic projectile launching system in accordance with the present invention. This system virtually eliminates the external magnetic signature without experiencing the reduction in projectile force seen in the multiple-rail launcher of FIG. 1. The coaxial launcher utilizes a coaxial cylindrical electrode geometry.

When switch 24 is closed, a direct current source such as homopolar generator 26 charges inductor 28 to full current. Then circuit breaker 30 is opened, delivering a high current to outer electrode 48 and inner electrode 50. Axial slots 52 have been cut in inner electrode 50 so that armature motion can be transferred to a projectile. This divides inner electrode 50 into segments. Although three segments are shown in FIG. 10, it must be understood that any number of segments could be used in accordance with this invention. For clarity, the high current source is shown as being connected to only one of the inner rail segments. In practice, all of the inner rail segments would be connected to the source. Movable armatures 58 shown in FIG. 11 are located between electrodes 48 and 50 to complete the circuit. A high current flowing in these armatures and electrodes electromagnetically propels the armatures along the electrodes. Insulating electrode supports 54 separate the inner electrode 50 from the outer electrode 48 and prevent movement of the inner electrode segments.

A projectile is accelerated within inner electrode 50 by means of a projectile driving armature assembly as shown in FIG. 11. A projectile driving plug 56 is located within the inner electrode and rigidly connected to armatures 58 by means of insulating armature supports 60 which pass through the inner rail slots. The electromagnetic propulsion of armatures 58 along the electrodes, thereby moves plug 56 along the inner electrode. The inner electrode 50 with slots 52 and inner electrode segment supports 54 are shown in FIG. 12. Slots 52 can be twisted to achieve a rifling effect which would impart spin on the projectile driving armature assembly. This spin can be transferred to a projectile by a splined or keyed shaft, similar to that shown in FIG. 8.

Greater projectile acceleration for a given electrode current can be achieved through the addition of augmentation rails. FIG. 13 shows a cross sectional view of the augmented coaxial launcher of FIG. 14, taken approximately along line XIII—XIII. Augmentation electrodes 62 and 64 have been added to the launcher and would be connected by means of annular end caps such that current flow is in the same direction in outer electrodes 48 and 62 and current flow is in the same direction in inner electrodes 50 and 64. Insulating electrode supports 55 hold the inner electrode segments in place. The end cap connectors 66 and 68 for the electrodes of FIG. 13 are shown in FIG. 14. These end caps would be perforated to allow for the insertion and exit of the armatures. FIGS. 15 and 16 are cross-sectional views of the end caps in FIG. 14, taken approximately along lines XV—XV and XVI—XVI, respectively.

Although three slots are shown in the inner electrode in FIG. 13, the number of slots is arbitrary and may be increased to a large number without departing from this invention. Because of the large repulsive forces on the electrodes during a launch, inner slotted electrodes will tend to collapse. Therefore, electrode segment support rails must be capable of withstanding high tensile forces. By increasing the number of segments, this problem becomes less severe.

Figure 17:
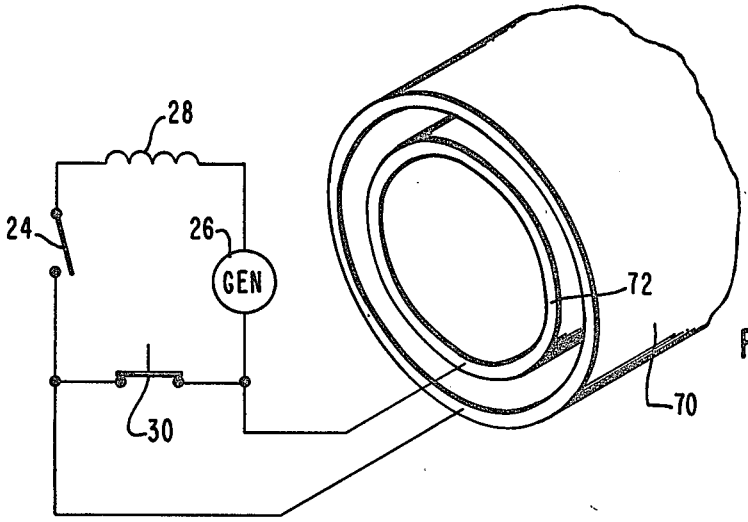
FIG. 17 shows an alternative embodiment of a coaxial electromagnetic projectile launching system in accordance with the present invention.
Figure 18:
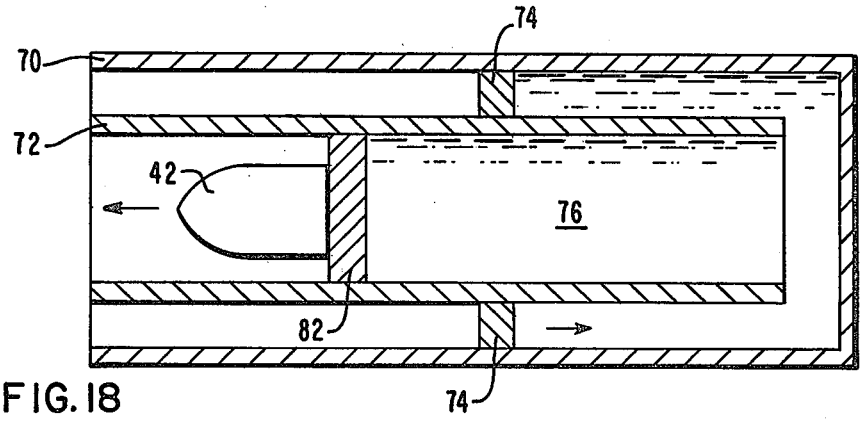
FIG. 18 shows a cross section of the launcher of FIG. 17.

FIG. 17 shows a coaxial electromagnetic projectile launching system with an unslotted inner electrode. This embodiment operates in the same manner as the launcher shown in FIG. 10 except that the armature is not connected to the projectile. The armature 74 may be simply a stack of annular disks fitted between conductors 70 and 72 as shown in FIG. 18.

In order to achieve motion of the projectile 42, the armature 74 must travel backwards from the muzzle to the breech displacing a liquid 76 which drives the projectile 42 and projectile seal 82 forward. Since structural integrity can be maintained in the coaxial electrodes, the system can be made liquid tight. Because of the necessity of accelerating the driving liquid, this system would be practical for moderate velocities.

Figure 19:
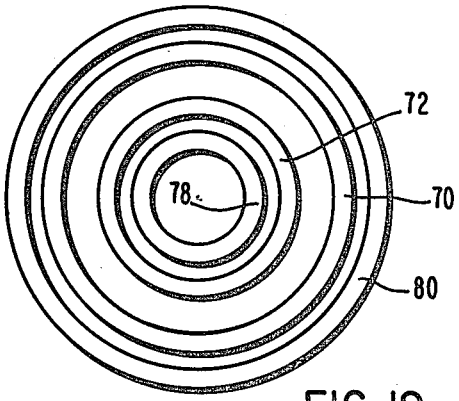
FIG. 19 shows the addition of augmentation electrodes to the launcher of FIG. 17.

This launcher can be augmented by adding additional inner 78 and outer 80 electrodes as shown in FIG. 19. Annular end caps similar to those disclosed for the slotted coaxial launcher would be used to connect the augmentation electrodes such that all inner electrodes carry current in the same direction and all outer electrodes carry current in the same direction.

Launchers built in accordance with the present invention will produce an external magnetic field which is considerably smaller than the field produced by prior art launchers which use a two parallel rail geometry. Therefore, present invention launchers will require less magnetic shielding than prior art launchers thereby achieving a cost and weight reduction.

What is claimed is:

1. An electromagentic projectile launching system comprising:
   - a cylindrical barrel;
   - a plurality of conductive rails distributed azimuthally on the inner surface of said barrel;
   - a plurality of conductive armatures disposed between said conductive rails;
   - an insulating core to which said armatures are radially attached;
   - a source of current; and
   - commutating means for connecting said current to said rails, wherein current flowing longitudinally within said rails in the wake of said armatures, and through said armatures produces magnetic fields which propel said armatures along said rails.

2. An electromagnetic projectile launching system as recited in claim 1, wherein said rails are spirally disposed along the axis of said barrel.

3. An electromagnetic projectile launching system as recited in claim 2, wherein said core has means for connection to a projectile for imparting spin to the projectile during a launch.

4. An electromagnetic projectile launching system as recited in claim 3, wherein said means for imparting spin is a plurality of splines on a shaft connected to said core.

5. An electromagnetic projectile launching system as recited in claim 3, wherein said means for imparting spin is a keyed shaft connected to said core.

6. An electromagnetic projectile launching system as recited in claim 1, wherein said barrel is slotted to accept said rails.

7. An electromagnetic projectile launching system as recited in claim 1, wherein said rails have a rectangular cross section.

8. An electromagnetic projectile launching system as recited in claim 1, wherein said armatures comprise a multi-layer stack of a plurality of copper leaves.

9. An electromagnetic projectile launching system as recited in claim 1, wherein said source of current comprises:
   - an induction coil; and
   - a direct current generator connected in series with said induction coil.

10. An electromagnetic projectile launching system as recited in claim 1, wherein alternate ones of said conductive rails are electrically connected together at one end, said one end being electrically connected to said source of current.

11. An electromagnetic projectile launching system as recited in claim 1, further comprising:
   - additional conductive rails disposed generally parallel and adjacent to said conductive rails and electrically connected in series with said conductive rails.

12. An electromagnetic projectile launching system comprising:
   - a pair of cylindrical coaxial conductive electrodes;
   - an annular conductive armature disposed between said electrodes and in sliding electrical contact with said electrodes;
   - a plurality of axial slots in the inner one of said pair of electrodes;
   - a central plug slidably disposed within the inner one of said pair of electrodes;
   - a plurality of insulating support arms which pass through said slots and rigidly attach said armature to said central plug;
   - a plurality of insulating support rails running axially between said electrodes, which support the segments of the inner one of said electrodes created by said slots;
   - a plurality of apertures in said armature through which said support rails pass;
   - a source of current; and
   - a commutating means for connecting said current to said electrodes, wherein current flowing longitudinally within said electrodes and through said armature produces magnetic fields which propel said armature along said electrodes.

13. An electromagnetic projectile launching system as recited in claim 12, wherein said slots and said support rails are spirally disposed along the axis of said electrodes.

14. An electromagnetic projectile launching system as recited in claim 13, wherein said plug has means for connection to a projectile for imparting spin to the projectile during a launch.

15. An electromagnetic projectile launching system as recited in claim 14, wherein said means for imparting spin is a plurality of splines on a shaft connected to said plug.

16. An electromagnetic projectile launching system as recited in claim 14, wherein said means for imparting spin is a keyed shaft connected to said plug.

17. An electromagnetic projectile launching system as recited in claim 12, wherein said armature comprises a multi-layer stack of a plurality of copper leaves.

18. An electromagnetic projectile launching system as recited in claim 12, wherein said source of current comprises:

an induction coil; and a direct current generator connected in series with said induction coil.

19. An electromagnetic projectile launching system as recited in claim 12, wherein said commutating means is a switch.

20. An electromagnetic projectile launching system as recited in claim 12, further comprising:

a plurality of cylindrical coaxial electrodes having a common axis with said pair of electrodes and disposed inside said inner one of said pair of electrodes and possessing axial slots in the same radial position as said slots in the inner electrode of said pair of electrodes;

additional cylindrical coaxial electrodes having a common axis with said pair of electrodes and disposed outside of the outer one of said pair of electrodes;

a plurality of conductive annular end caps, providing an electrical connection between said plurality of inside electrodes and said additional outside electrodes, said end caps having an aperture through which a projectile can pass; and a plurality of insulating support rails disposed between said segments of said inner one of said pair of electrodes and the segments of each successive inner electrode.

21. An electromagnetic projectile launching system comprising:

a pair of cylindrical coaxial electrodes;

a conductive annular armature disposed between said electrodes and in sliding electrical contact with said electrodes;

an insulating liquid disposed within said electrodes and between said armature and a projectile;

a source of current; and commutating means for connecting said current to said electrodes, wherein current flowing longitudinally within said electrodes and through said armature produces magnetic fields which propel said armature along said electrodes.

22. An electromagnetic projectile launching system as recited in claim 21, wherein said source of current comprises:

an induction coil; and a direct current generator connected in series with said coil.

23. An electromagnetic projectile launching system as recited in claim 21, wherein said commutating means is a switch.

24. An electromagnetic projectile launching system as recited in claim 21, further comprising additional cylindrical coaxial electrodes wherein said additional electrodes are disposed in equal numbers inside the inner one of said pair of electrodes and outside of the outer one of said pair of electrodes and are connected such that current flows in the same direction in all inner electrodes and in the same direction in all outer electrodes.

* * * * *